US005358099A

United States Patent [19]

Tavone

[11] Patent Number: 5,358,099

[45] Date of Patent: Oct. 25, 1994

[54] RING DISPLAY

[76] Inventor: John H. Tavone, 2315 SW. 31st Ave., Hallandale, Fla. 33009

[21] Appl. No.: 101,238

[22] Filed: Aug. 2, 1993

[51] Int. Cl.[5] ..... A45C 11/04

[52] U.S. Cl. ..... 206/6.1; 206/45.14; 206/45.19

[58] Field of Search ..... 206/6.1, 805, 807, 45.14, 206/45.19

[56] References Cited

U.S. PATENT DOCUMENTS

| | | | |
|---|---|---|---|
| Re. 4,163 | 10/1970 | Hart, Jr. . | |
| 507,864 | 10/1893 | Wertheimer | 206/45.14 X |
| 672,561 | 4/1901 | Loeb . | |
| 690,399 | 1/1902 | Coffin . | |
| 1,907,681 | 5/1933 | Sundee . | |
| 2,144,336 | 1/1939 | Katz | 206/45.19 |
| 2,321,339 | 6/1943 | Wadsworth | 206/45.14 X |
| 3,123,208 | 3/1964 | Barnum et al. | 206/45.14 |
| 3,900,060 | 8/1975 | Shammas | 150/52 R |
| 4,180,169 | 12/1979 | Michels | 206/45.14 X |
| 4,300,674 | 11/1981 | Davet | 206/45.14 |
| 4,350,249 | 9/1982 | Caston | 206/566 |
| 4,552,264 | 11/1985 | Quarrell et al. | 206/45.19 |
| 4,880,117 | 11/1989 | Garganese | 206/45.14 |
| 5,018,253 | 5/1991 | Oppenheimer | 24/458 |

*Primary Examiner*—William I. Price
*Attorney, Agent, or Firm*—Millen, White, Zelano & Branigan

[57] ABSTRACT

A display device is provided for rings, wherein the ring is secured to a base, such as the bottom of a ring box, so as to prevent theft. A method for encouraging the theft of ring boxes with the contents therein is also provided.

10 Claims, 1 Drawing Sheet

RING DISPLAY

FIELD OF THE INVENTION

This invention relates to a display device for rings designed to reduce pilfering and, more particularly, to a ring display which prevents the palming of rings therefrom.

BACKGROUND OF THE INVENTION

In the marketing of jewelry, a retailer is sometimes required to balance the volume of sales provided by greater public access to the merchandise and the loss of merchandise from pilfering, which is inherent in providing such public access. Pilfer-resistant display devices for rings, eyeglasses, and other accessories have been available for years. For example, U.S. Pat. No. 672,561 describes a show tray for finger rings which prevents the rings from being taken surreptitiously. Related devices are described in U.S. Pat. Nos. 5,018,253; 4,350,249; 3,900,060; 3,123,208; and 1,907,681. These devices remove some aspect of public access to the merchandise by either confining the merchandise to a secured display limited in size and/or by requiring assistance from a salesperson to inspect or wear the merchandise. The securing mechanism for even more recent designs of pilfer-resistant display devices, such as that described in U.S. Pat. No. 5,018,253, typically require disengagement by a salesperson to allow removal of the merchandise from the display for inspection. Limitations on public access can be compensated for by increased investment in equipment (displays) or personnel (salespersons). The increased investment and cost necessary in utilizing conventional pilfer-resistant display devices for the sale of jewelry in high volume are typically-impractical. It is desirable to provide a pilfer-resistant ring display which is inexpensive to produce and does not place an additional burden on sales personnel and, therefore, practical for use in high volume sales.

In addition, the loss of finger rings to pilfering presents a unique problem when the rings are displayed in individual boxes. The loss of rings to pilfering is much higher than that of earrings and necklaces due to the relative ease in removing the ring from individual display boxes. There is also a unique aspect to the problem palming of finger rings from individual display boxes in that the loss may go undetected where the individual ring box remains closed. The theft may be first discovered by a customer, either before or after purchase, which taxes a retailer's goodwill. This is not a problem when earrings and necklaces are stolen, since they are typically taken with the display box they are in. Therefore, it is desirable to provide a pilfer-resistant ring box which prevents or reduces the theft of the rings alone, requiring the theft of the ring box with the ring so that retailers can detect the loss more easily, and such thefts will not affect customer relations by leaving empty ring boxes on display.

SUMMARY OF THE INVENTION

It is an object of the present invention to provide a display for rings which reduces pilfering.

It is another object of the present invention to provide a pilfer-resistant display box for rings which eliminates palming of the finger rings therefrom.

It is yet another object of the present invention to provide a display device for rings which reduces pilfering and is both inexpensive to manufacture and use.

It is a further object of the present invention to provide a method for preventing the theft of rings without the ring boxes they are in so that the loss of merchandise can be detected by the merchant more easily, and empty boxes will not remain in inventory.

Upon further study of the specification and appended claims, further objects and advantages of this invention will become apparent to those skilled in the art.

These and other objects are achieved with the ring display provided by this invention, which comprises a base, a mounting card for a ring having a decorative surface supported above the base, and means for supporting the decorative surface above the base. The decorative surface has a groove which receives the band of a ring so as to support the ring in an upright position with its band perpendicular to the decorative surface. The groove within this decorative surface has at least one hole for the passage of two ends of an elastic cord. A ring is positioned in the groove within the decorative surface of the mounting card, and an elastic cord is threaded through the ring band. Both ends of the elastic cord are threaded through the hole in the groove, and each end is bonded to the base by bonding means so as to anchor the ring to the base.

In the method aspect of this invention, there is provided a process for preventing the theft of a ring without the ring box it is in, which comprises anchoring the ring box to said ring by threading an elastic cord through the band of said ring and bonding both ends of the elastic cord to the ring box with bonding means. The elastic cord and ring bonding means are sufficiently strong such that the ring cannot be separated from the ring box without cutting the elastic band with a tool.

DETAILED DESCRIPTION OF THE PREFERRED EMBODIMENTS

Figure 1:
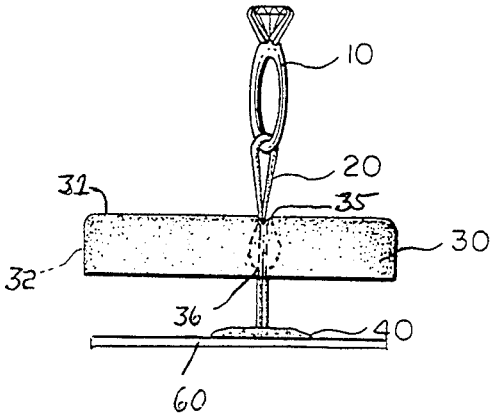
FIG. 1 is a side view of the components of a ring display in accordance with this invention, with the elastic cord in an extended position.

Referring to FIG. 1, there is shown a portion of the assembled components of the display device of this invention in a generic embodiment. A base 60 is shown as a generic flat plate to better illustrate the other components of the display device. The configuration of the base can vary significantly from a flat plate, to the bottom of a ring box or the bottom of a display case. The base can vary widely in composition, including paper, cardboard, hardboard, steel or other metal, plastic, glass, wood, and the like. For embodiments of FIG. 1, it is preferable that base 60 provide a surface which bonds well to adhesive 40. A mounting card 30 has a decorative surface 31 supported above the base 60 by sidewalls 32. A groove 35 is positioned within decorative surface 31 and is adapted to receive and support the band of a ring. At the base of the groove 35 is at least one hole 36 for the passage of an elastic cord 20. The elastic cord 20 is threaded through the band of ring 10, and both ends thereof pass through the hole 36 in groove 35 to be bonded to a base 60 with adhesive 40. This configuration serves to anchor the ring 10 to the base 60.

As with the base 60, the mounting card 30 can vary significantly in shape, configuration, and composition. It typically comprises an insert for a ring box, the shape and configuration being defined by the bottom of the ring box. The decorative surface 31 of the mounting card 30 is typically a flocked or fleeced surface, but this surface can vary widely in shape and composition, as well. The means for supporting the decorative surface above the base can vary significantly in design and configuration. In FIG. 1, sidewalls 32 integrated in mounting card 30 provide support means. The support means can be an element separate from the mounting card 30, or it can form part of the base 60.

Groove 35 within the decorative surface 31 is adapted to receive the band of a ring and support the ring 10 in a manner such that its band is perpendicular to the plane of the decorative surface 31. The embodiment of FIG. 1 displays the ring in a position consistent with that when worn on a finger.

The position of the hole 36 within the groove 35 is not critical; however, in preferred embodiments, the hole is positioned at the bottom of the groove 35, as in FIG. 1, so that the hole 36 and elastic cord are not visible. In certain embodiments, more than one hole 36 may be used. The hole (or holes) 36 must be sufficiently large to allow passage of both ends of the elastic band 20. The hole may be sufficiently large to approach the size of a slot, allowing the elastic cord 20 to be threaded through the ring band without perforating the groove 35.

The elastic cord 20 can comprise any string, cord, thread, or cable which is resilient along its length. Strings of solid rubber may be suitable, as well as woven cords thereof, conventionally known as shock cord, and elastic bands. Preferably, the elastic cord 20 has sufficient strength to withstand tearing or breakage when attempting to manually separate the ring from the base. Most preferably, the elastic cord 20 has a strength which requires that it be cut with a tool to separate the ring 10 from the base 60. The length of the elastic cord 20 can vary widely. In certain embodiments, it may be desirable to have the elastic cord 20 of a length which allows the consumer to remove the ring 10 from the groove 35 and place the ring 10 on a finger while still anchored to the base 60. In other embodiments, it may desirable to shorten the length of the elastic cord so that it is never visible when displaying the ring 10.

The elastic cord 20 can be anchored to the base by various means, including bonding with an adhesive, such as a silicone elastomer, or mechanically attaching the ends to the base by tying or clamping means. Where an adhesive is used, it is preferable that the diameter of the mass of adhesive be larger than the diameter of the hole 36. This is desirable in that should the adhesive 40 fail to remain adhered to the base 60, the mounting card 30 will remain with the ring, since the adhesive cannot be pulled through the hole. This provides further assurance against palming of the ring.

The ring 10 which forms part of this display can be any ring having a closed band. If the band is open, the elastic cord 20 will be ineffective in anchoring the ring to the base 60. Certain expandable rings are also suitable for this invention, where the expanding band provides an enclosed loop.

Figure 2:
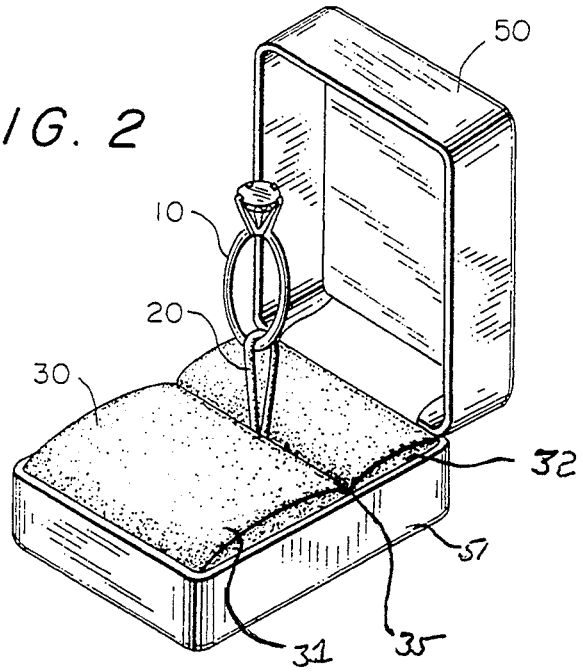
FIG. 2 is a perspective view of a pilfer-resistant ring box provided by the present invention in an open position with the elastic cord extended.

FIG. 2 illustrates a preferred embodiment of this invention which is a pilfer-resistant ring box with means to secure the ring. The ring box bottom serves as a base 51. The ring box top 50 is shown open. A mounting card 30 serves as an insert to the bottom of the ring box, with decorative surface 31 deftly exposed. A groove 35 for retaining and supporting the ring is shown. Elastic cord 20 is shown extended and is of a length sufficient to allow the ring to be removed from the groove and worn on a finger. The mounting card 30 incorporates sidewalls 32, which provide means for supporting the decorative surface 31 above the base 51.

Figure 3:
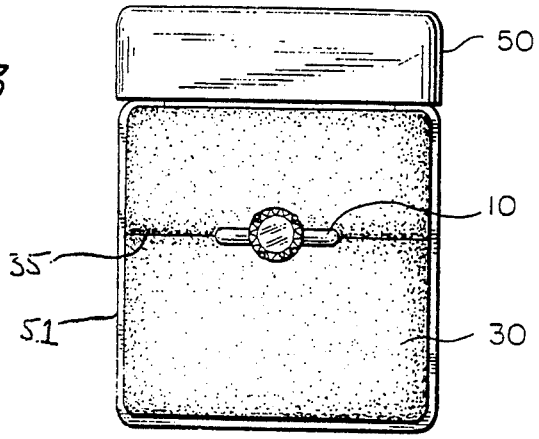
FIG. 3 is a downward view of a pilfer-resistant ring box provided by the present invention in an open position with the elastic cord constricted.

FIG. 3 provides another view of the preferred embodiment of FIG. 2, wherein the ring 10 is supported and retained in groove 35. The elastic cord is concealed, as is the bonding means for anchoring the ring to the base.

Another aspect of this invention is a method for preventing the theft of a ring without the ring box in which it is displayed. This comprises anchoring the ring boxes to the ring displayed therein by passing an elastic cord through the ring band and bonding both ends of the elastic cord to the individual ring box. In such a process, it is preferable that the elastic cord be sufficiently strong so that the ring cannot be separated from the ring box without cutting the elastic cord with a tool and that the bond between the ends of the elastic cord and the ring box be sufficiently strong so that they cannot be separated manually.

The entire texts of all applications, patents, and publications cited herein are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

I claim:

1. A ring display which comprises:

a base;

a mounting card for a ring having a decorative surface supported above said base, said mounting card having a groove within the decorative surface adapted to receive the band of a ring and support said ring with its band perpendicular to the plane of the decorative surface, said groove within the decorative surface having at least one hole for the passage of two ends of an elastic cord;

means for supporting the decorative surface of said mounting card above said base;

a ring;

an elastic cord threaded through the band of said ring, wherein the ends of said elastic cord are threaded through at least one hole in said groove and are bonded to the base so as to anchor said ring to said base; and means for bonding both ends of said elastic cord to said base.

2. The ring display of claim 1, which is a ring box wherein the base of the ring display is the bottom of said ring box.

3. The ring display of claim 2, wherein the ends of the elastic cord are permanently bonded to the bottom of the ring box.

4. The ring display of claim 1, wherein the means for bonding both ends of said elastic cord to said base is a mass of adhesive, said mass of adhesive being sufficiently large to provide a diameter which is larger than the diameter of the hole in said groove for the passage of two ends of said elastic cord.

5. The ring display of claim 2, wherein said elastic cord has a length which allows the ring to be removed from the groove in the decorative surface of said mounting card and worn on a finger while anchored to the base.

6. The ring display of claim 2, wherein said elastic cord has a length which does not allow the ring to be removed from the groove in the decorative surface of said mounting card.

7. The ring display of claim 1, wherein said mounting card incorporates sidewalls as the means for supporting the decorative surface.

8. The ring display of claim 1, wherein said ring is anchored to the base with sufficient strength such that the ring cannot be manually separated from the base.

9. The ring display of claim 8, wherein said ring is anchored to the base with sufficient strength along its length such that it is necessary to cut the elastic cord with a tool to separate the ring from said base.

10. A method for preventing the theft of a ring without the ring box in which it is displayed, said method comprising anchoring said ring box to the ring displayed therein with elastic cord of sufficient strength such that said ring cannot be manually separated from said ring box without the use of a tool.

* * * * *